US005100124A

United States Patent [19]

Pouliquen

[11] Patent Number: 5,100,124

[45] Date of Patent: Mar. 31, 1992

[54] ARTICLE STOPPING APPARATUS

[75] Inventor: Alain N. Pouliquen, Green Bay, Wis.

[73] Assignee: John Brown Development Company, Oconto Falls, Wis.

[21] Appl. No.: 589,992

[22] Filed: Sep. 28, 1990

[51] Int. Cl.[5] ..... B65H 29/38

[52] U.S. Cl. ..... 271/183; 198/418.9; 198/419.1

[58] Field of Search ..... 198/418.9, 419.1; 271/182, 183, 202, 256

[56] References Cited

U.S. PATENT DOCUMENTS

| | | | |
|---|---|---|---|
| 3,610,401 | 10/1971 | Herendeen et al. | 198/418.9 |
| 3,834,288 | 9/1974 | Behrens et al. | 198/418.9 |
| 3,948,153 | 4/1976 | Dutro et al. | 198/418.9 |
| 4,076,114 | 2/1978 | Tokuno | 198/418.9 |
| 4,183,518 | 1/1980 | Brockmuller et al. | 198/418.9 X |
| 4,333,559 | 6/1982 | Reist | 198/419.1 X |
| 4,546,871 | 10/1985 | Duke | 198/418.9 |
| 4,585,227 | 4/1986 | Muller | 198/418.9 X |
| 4,921,088 | 5/1990 | Ter Horst | 198/419.1 X |

*Primary Examiner*—Frank E. Werner
*Assistant Examiner*—Craig Slavin
*Attorney, Agent, or Firm*—Andrus, Sceales, Starke & Sawall

[57] ABSTRACT

Apparatus for separating sequential batches of overlapping sheets includes a conveyor of laterally spaced belts. Lift bars secured to tubes are mounted for vertical positioning above the belts to raise the sheets from the conveyor and remove the moving force. The lift bars includes spaced vacuum openings coupled to the tube, which is coupled to a vacuum source. The openings are spaced for alignment with the trailing portions of sheets moving through the conveyor. A piston in the tube selectively opens and closes the openings. The tubes are pivotally mounted at the downstream ends and the piston projects from the upstream end of the tube. A cam drive reciprocates the piston and simultaneously raises and lowers the tubes. The cam drive includes an inclined cam rod on which a motor-driven rack is slidably mounted. A link connects the rack to the outer end of the piston. The rack reciprocates on the cam rod and thereby pivots the vacuum tubes about the pivot unit and simultaneously opens and closes the vacuum openings. The apparatus stops the leading sheets with successive sheets moving into increasing overlap. The leading end of a batch is stopped until the vacuum tubes and bars are lowered to place and release the sheets onto the conveyor belts in spaced relation to the preceding batch of sheets. Wheels or other stop devices may be coupled to the top side of the sheets to assist the stopping action.

18 Claims, 3 Drawing Sheets

ARTICLE STOPPING APPARATUS

BACKGROUND OF THE PRESENT INVENTION

This invention relates to an article stopping apparatus and particularly to such an apparatus for receiving a series of overlaying and overlapping sheet-like articles and stopping movement of successive articles to form a gap between successive batches or groups of the articles.

In the processing of sheet-like members, a web is sequentially cut into a series of sheet-like members for subsequent processing. In many in-line processes, the sheets are assembled in a continuous line of overlapping sheets with each of the following cut sheets moved into overlapping engagement with the preceding downstream sheet, generally referred to a shingling process. The shingled sheets may be divided into sequential batches for providing a precise number of sheets assembled to a suitable stacking apparatus. In the forming of batches, various systems have been proposed including a stopping apparatus for progressively slowing down and generally stopping the sheet at the upstream end of a batch and progressively stopping subsequent sheets with an increased overlap of succeeding sheets to provide a concentrated group of the sheets with the increased overlap which are then rapidly fed from the stopping apparatus as at least a part of a batch to a stacker or other processing mechanism or apparatus.

For example, the stepping apparatus may include an overlying member which is moved downwardly and progressively into abutting engagement with the incoming stream of shingled sheets on the conveyor thereby stopping the feed of the downstream sheet on the conveyor while allowing the controlled and partial increased movement of the upstream sheets over the conveyor to increase the overlap prior to terminating of their movement and thereby defining the leading end of a batch. Once a selected gap is created with respect to a preceding batch, the overlying stopping member is raised and sheets are released and the batched sheets are allowed to rapidly move from the stopping apparatus. As the leading sheet of the new batch approaches the discharge end of the apparatus, the overlying member again moves downwardly into engagement therewith to prevent its continuous movement and the apparatus again recycles to effect the desired increased overlapping within the next batch in the forming of a new batch.

U.S. Pat. No. 3,337,666, which issued Mar. 19, 1968 discloses a similar means in combination with means for holding of the articles in spaced relation to the conveyor to assist in the batching process.

These and other patents disclose various batching systems generally using some form of a mechanical stopping mechanism. The mechanism which holds the shingled sheets in a retarded position on the conveyor of course are subject to relative movement between the sheets and the conveying mechanism. This may be undesirable in certain applications particularly those where the underside of the sheet can raise printed matter or other matter which might be subject to damage by the relative motion. Further, such mechanical devices rely on a mechanical interengagement generally with the leading edge of the sheet and require relatively complex mechanisms which are subject to various maintenance cost and mechanical failures.

There exists a need for an improved system for holding of the shingled sheets in appropriate fashion to allow the increased overlapping with a minimum complexity of apparatus and yet which operates at high speed with reliable stopping of the sheets and which is particularly adapted to in-line processing of the sheets.

SUMMARY OF THE INVENTION

In accordance with the invention, a conveying unit receives overlapping articles or members to be separated in sequential and spaced batches which are delivered to a downstream unit such as a stacking station. The conveying unit includes a delay unit having a fluid pressure coupling unit interposed between the incoming stream of members and the downstream unit for temporarily stopping the movement of succeeding members and accumulating the incoming members during the transfer and processing of the preceding members to thereby separate articles within the delay unit from the preceding articles. In accordance with a particularly practical embodiment of the invention, the conveying unit includes a plurality of laterally spaced conveying elements. A plurality of control units which lift and hold the members are interposed between the conveying elements. The lift and hold elements are mounted for vertical movement, from below the conveying elements, upwardly above the conveying elements to raise the overlapping members from the conveying elements and remove the moving force therefrom, hold the elements and successively grip the members in fixed position. The hold elements are, in a preferred construction, vacuum elements providing individual vacuum gripping portions longitudinally spaced of the lift and hold unit. The vacuum elements are successively activated to establish a controlled increased overlapping of the individual members within the delay unit to thereby progressively stop the incoming members during the stacking or other processing of the preceding members. The lift and hold units are then lowered and the vacuum released, with the released members rapidly transferred from the delay unit to the downstream unit. The stream of members continues until a selected number of members to form a stack has moved through the hold conveying unit and the cycle is repeated. In the embodiment including a stacking unit, the stacking unit includes a conveying unit for transport of the increased overlapped members into a vertical bottom stacker. The members move successively into a vertical stack with the members dropping downwardly on a support structure during the separation period of the next batch.

In the preferred construction, the apparatus includes a plurality of laterally spaced conveyor belts mounted on a common drive system for simultaneous movement. The overlapping incoming members are carried in a horizontal plane through the apparatus. Interposed between the belts are elongated vacuum bars, each of which includes a substantial plurality of longitudinally spaced vacuum openings or nozzles. Each bar is similarly coupled to a common support for correspondingly raising and lowering the vacuum bars. The vacuum bars are supported in a generally inclined orientation with the downstream or leading end located above the upstream or trailing end of each bar. The bars are pivotally mounted at the opposite ends for vertical raising and lowering the vacuum openings or nozzles secured to the bar. In a stopping sequence, the associated leading end of each bar is raised to locate the initial vacuum opening or nozzles above the plane of the conveying elements and to thereby simultaneously raise the incoming overlapping members. The initial or downstream vacuum nozzles grip the trailing position of the first member of the incoming members to terminate the forward movement along the conveying path. The opposite end of the vacuum bars include a conjointly actuated raising and lowering unit for progressively raising of the upstream end of the vacuum bars above the level of the conveying elements or belts. As a result of the inclined bar orientation, successive openings or nozzles move into engagement with the incoming members and in particular engage the trailing end portions of the members to effectively terminate the movement of successive members as they are raised from the belt elements with an increased overlapping condition relative to the immediately preceding member. Thus, as each leading member of the successive members is engaged by the vacuum element, its movement essentially terminates. The following members however are continued to be moved by the conveying belts and thus move into further overlapping engagement with the immediately preceding stopped member. The overlap increase continues until such time as an aligned nozzle moves upwardly into raised and holding engagement.

In an actual commercial embodiment, each of the vacuum bars include a common tubular member with a rectangular bar secured to the tubular member. Openings are longitudinally spaced in the rectangular bar and the top wall of the tubular member. The vacuum source is secured to the downstream or leading end of the tubular member. A piston is journaled in the tubular member and the piston rod projects outwardly of the upstream or trailing end. A separate vertical positioning unit is secured to the vacuum bars for simultaneously positioning of the leading end of all vacuum bars and a second vertical position unit secured to the outer end of the piston rod and includes a powered linkage mechanism which simultaneously serves to raise and lower the rod and thereby pivot the vacuum bar about the forward raised end in a progressive defined manner while simultaneously moving of the piston rod to establish and effect the desired successive opening and closing of the successive vacuum openings. In this manner, the system provides a means for effectively lifting of the members to remove the forward force on the members to more readily permit stopping and holding of the members by engagement with the vacuum openings, and lowering of the members to again apply the forward conveying force on the batch of members.

If desired or necessary, a mechanical holding device may be mounted engaging the leading member in each group or batch, and may be mounted to the opposite or top side of the overlapping members within the separation unit. Such an element may, for example, include a wheel unit located above the upstream end of the vacuum bar unit, or a simple angled bar or belt adapted to further engage the upper and leading ends of the members in a progressive sequence to assist in the holding of the members against forward movement.

The method and apparatus of the invention provides a highly effective means for controlling the batch flow of overlapping members in a high speed processing line such as encountered in forming of signatures and other printed matter in the graphics art industry as well as in other sheet processing systems.

BRIEF DESCRIPTION OF THE DRAWINGS

The drawings furnished herewith generally illustrate the best mode presently contemplated for the invention and are described hereinafter.

In the drawings.

DESCRIPTION OF THE ILLUSTRATED EMBODIMENT

Figure 1:
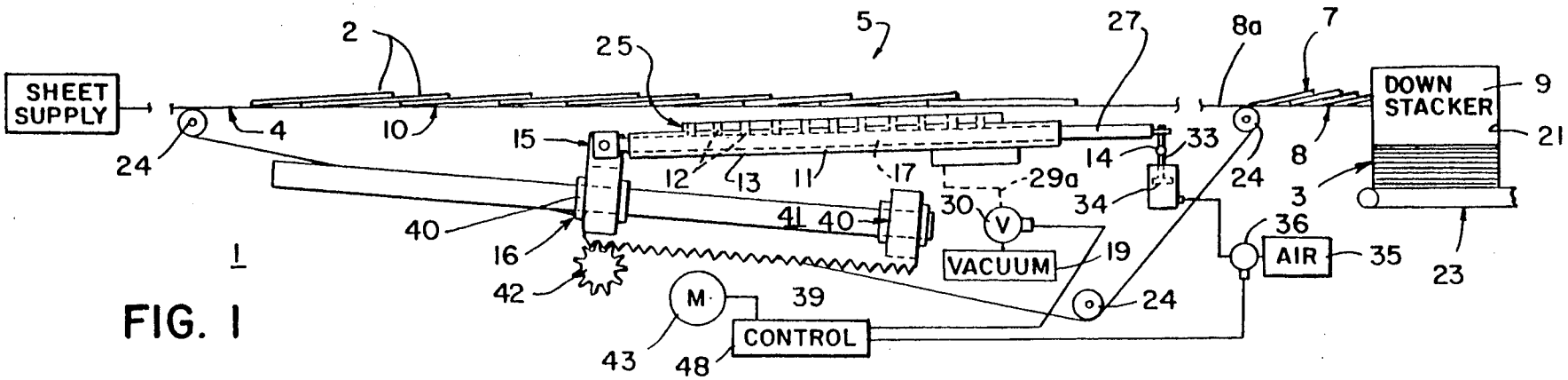
FIG. 1 is a side elevational view of a sheet forming and stacking apparatus incorporating an embodiment of the present invention.

Referring to the drawings and particularly to FIG. 1, a sheet assembly apparatus 1 is illustrated for assembling a continuous series of individual sheets 2 into a series of stacks 3 of sheet 2. An input conveyor 4 transports a continuous stream of shingled or overlapping sheets 2, which have been formed and assembled onto conveyor 4 in any suitable apparatus. In-line machine, not shown, are known in which sheets 2 may, for example, be formed from a web of indefinite length which is passed through a rotary cutter to form a series of sheets which are then passed through a shingling apparatus to form the sheets 2 as shown on conveyor 4. The sheets 2 may be individual members or multi-page members such as signatures and generally are to be gathered into like numbered groups, shown as stacks 3 for subsequent processing. A stopping unit 5 for separating successive batching sheets, is mounted to receive the stream of shingled sheets 2 and momentarily stops or delays movement of the overlapping sheets 2 downstream onto a transfer conveyor 8 to form a gap 8*a* between successive batches 7 of sheets transferred into the stack 3. During the stopping period, the sheet overlap is increased to permit continued movement of the incoming sheets prior to discharging of each batch 7 onto a transfer conveyor 8. A downstacker 9 is mounted immediately downstream of the conveyor 8 and receives the batch 7 of shingled sheets 2 and stacks the sheets in the downstacker 9 in the illustrated embodiment to form stacks 3. During the transfer and stacking of the batch 7 from conveyor 8 to the downstacker 9, a new batch 7 is formed with the leading or downstream sheets 2 held at the separation and stopping apparatus or unit 5. The present invention is particularly directed to the construction and operation of the unit 5 to establish and maintain an accurate sequential formation of a gap between successive batches 7 of sheets 2. Each batch 7 may consist of the sheets 2 held on the conveying unit of the unit 5 and any additional upstream sheets 2, with the sheets fed continuously through the stopping unit 5 to the conveyor 8. When a selected number of sheets have passed from unit 5 and thus to conveyor 8, unit 5 is operated to stop further movement of sheets 2 from unit 5 to conveyor 8, and thereby form gap 8*a* between the downstream batch 7 and the upstream batch 7, the leading sheets of which are delayed within the downstream end of unit 5.

Generally, in accordance with the illustrated embodiment of the present invention, the stopping unit 5 includes a belt conveyor 10 for transport of the sheets 2. The conveyors 4 and 8 are shown integrally formed with the conveyor 10 in the illustrated embodiment and includes a plurality of laterally spaced conveying members which are mounted to transport the overlapping shingled sheets 2 received from the infeed conveyor 4 to the transport conveyor 8 and downstacker 9. The conveyor 10 is illustrated as an endless belt structure having a plurality of laterally spaced belts 10*a* moving in a common horizontal plane for transport of the sheets 2 in such plane. Interposed between the laterally spaced belts 10*a* is a control assembly including a plurality of control units 11 forming a stopping control unit. Each of the control units 11 is shown including a rigid lifting bar having a first position located in or below the plane of the conveyor unit. In this position, the units 11 allow essentially unobstructed motion and movement of the overlapping sheets 2 through the stopping unit 5. The control units 11 are adapted to be raised upwardly above the level of the conveyor belts 10*a*, as shown in FIGS. 3, 4A, 4B and 4C. The upward movement and positioning of the control units 11 is initiated at the downstream end of the sheet flow and progresses upstream to the infeed end of the unit 5. As a result, the overlapping sheets 2 are progressively raised from the belts beginning with the most downstream sheet. As the sheet 2 is raised from the belt, the forward force on the sheet established by the conveyor belts is removed. The trailing sheet is still receiving the forward propulsion forces of the belts and thus moves upwardly into increased overlapping relationship to the downstream or preceding sheet.

In addition to the lifting of the bars and thereby sheets 2, a fluid holding force is specially applied to the raised sheets 2. Generally in a preferred and optimum construction, a vacuum holding assembly is incorporated into and associated with the control units 11 and includes longitudinally spaced vacuum coupling nozzles 12, each of which establish a vacuum holding force on the exposed bottom or underside trailing portion of each sheet 2, in synchronism with the raising of such sheet from the conveyor belts. The vacuum force is located to positively grip and hold each sheet 2 in fixed relation to the preceding overlapped trailing sheet to establish an essential precise increased overlap of successive sheets. This action permits continued movement of the conveyors and the incoming sheets 2 with an accurate assemblying of the leading sheets of each batch 7 within the unit 5. The unit 5 thus proceeds to assemble the plurality of incoming sheets 2 in increased overlapping position. When a preceding batch 7 has moved through conveyor 8 for proper stacking and removal such that a new batch can be transferred to conveyor 8, the control units 11 are lowered and the newly formed batch 7 is released and rapidly moved as a continuous stream from the unit 5 and the incoming conveyor 4 to conveyor 8. The unit 5 recycles to form the leading end of another batch after the last sheet of the preceding and previous batch is transported to conveyor 8 for feeding to the downstacker 9 or otherwise processed.

Generally, in the illustrated embodiment of the invention, each control unit ]1 includes a tubular lift member 13 with the nozzles 12 secured thereto. The members 13 are pivotally mounted at the downstream end of the unit 5 as by a pivot unit 14. A piston unit 5 is slidably mounted in the tubular lift member 13 and projects outwardly at the upstream end. A common reciprocating drive assembly 16 is secured to the projecting end of the piston unit 15. The drive assembly 16 operates to reciprocate the separate pistons 17 within the tubular members 13, and simultaneously raises and lowers the members 13 about the forward pivot unit 14. A vertical positioning unit 8, shown as a vertical reciprocating motor unit, is coupled to the pivot unit 14 for raising and lowering of the downstream end of the control bar. The pivot unit 14 raises the downstream end of the control unit above the conveyor unit and particularly the conveyor belts.

The vacuum assembly includes a vacuum source 19 coupled to the downstream end of the tubular member. The member 13 has an upper vacuum bar 25 secured to the member 13 with the nozzles 12 formed by longitudinally and equally spaced openings along the length of the bar and member 13. The nozzle openings 12 are located in the upper plane of the bar 25 which serves to engage and support the aligned trailing end portion 20 of the sheets 2. As the piston unit 15 is retracted, the vacuum pressure from the vacuum source 19 is transmitted through the nozzle openings 12 to the aligned sheet 2 which is thereby held in a substantially fixed position on the raised vacuum bars 25.

The members 13 with bars 25 are cyclically pivoted to lift and progressively stop the leading sheets 2 of a batch 7, and then reversed to drop the vacuum bars and place all raised sheets onto the conveyor. The batch 7, including sheets in unit 5 as well as following sheets 2 to form a proper numbering of sheets, are then propelled through the unit 5 into the transfer conveyor 8.

Thus, upon reversing of the system, the downstream ends of the member 13 via vacuum bars 25 are lowered beneath the plane of the conveyor belts 10*a*, and simultaneously with the downward pivoting, the vacuum is stopped or operatively decoupled, whereby the holding vacuum force is removed and the sheets 2 in unit 5 are released. As a result, the batch 7 of sheets 2 are lowered onto the high speed conveyor belts 10*a* of the unit 5 and move a stream onto the transfer conveyor 8 to the downstacker 9. The transfer conveyor 8 withdraws the batch 7 and as the last sheet of the total batch moves from the leading end of the control units 11, the stopping apparatus or unit 5 recycles to initiate formation of the leading end of another batch 7. The preceding batch thus moves forwardly and forms a gap with respect to the overlapping sheets being fed into a new batch 7 on the unit 5.

The transfer conveyor 8 is shown as a part of the batching conveyor 10. A separate conveyor, which is operated in synchronism with the unit 5, may also be used to rapidly transport the sheet batch from the stopping unit 5 to the downstacker 9.

The illustrated downstacker 9 includes a receiving receptacle 21 for successive receipt of the sheets 2 from the conveyor 8. The individual sheets are passed successively from the conveyor 8 into the receiving receptacle 21, and the sheets drop by gravity into a stack 3. The receptacle 21 is mounted for vertical movement in synchronism as the sheets accumulate. The final stack 3 is removed as by lateral transfer on a conveyor 23 for transfer from the stacking station, and a new batch 7 transferred from the unit 5 and conveyor 8 into the receptacle 21.

As noted previously, the present invention is particularly directed to a stopping unit 5, and the illustrated embodiment is now described in detail. The other components of the system may include any known or other suitable structure and the illustrated embodiments are only described to fully and clearly describe the illustrated embodiment of the batching unit.

More particularly in the illustrated embodiment of the invention, the illustrated batching unit 5 and particularly the conveyor belt unit 10 includes a plurality of laterally spaced endless belts 10*a*. Each belt 10*a* is looped about spaced pulleys or rollers 24 at the infeed end and the downstream or outfeed end and define a horizontal transfer run for carrying of the overlapping or shingled sheets 2 through the unit 5. The bottom run of the belts 10*a* are shown looped about a drive pulley or roller 24*a* secured below and generally adjacent the downstream end of the unit. The bottom run of the belts are driven through a suitable gear coupling to the main line of an in-line system or connected to a separate drive in such a manner as to provide correlated movement with other parts of the line. All belts 10*a* are driven at the same surface speed to provide a proper and aligned movement of the sheets into and through the stopping unit 5.

Figure 3A:
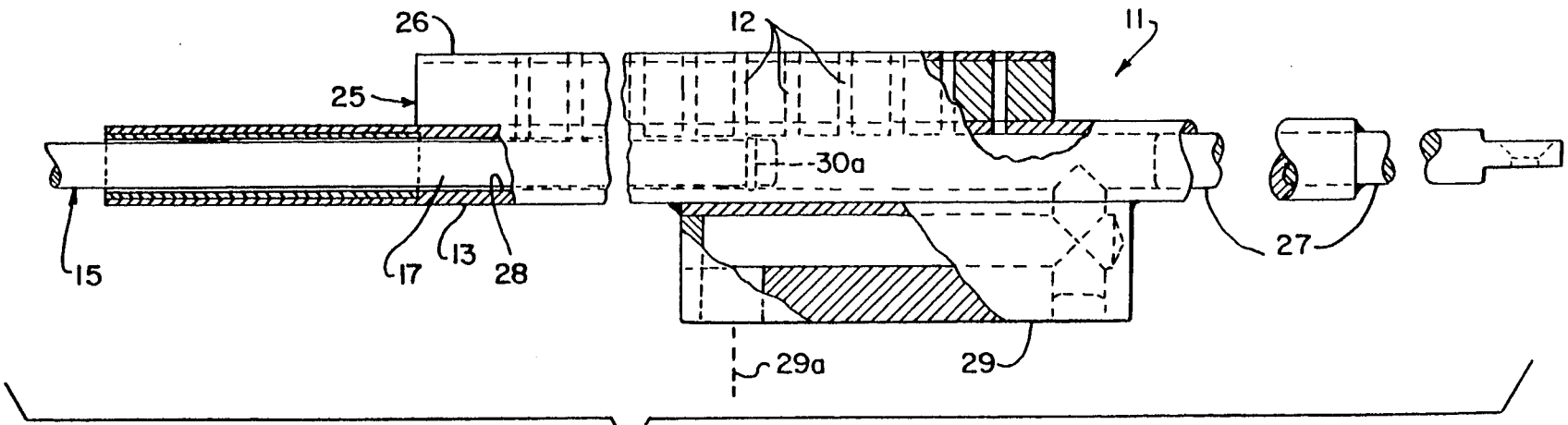
FIG. 3A is an enlarged view of a lifting control unit shown in FIGS. 1 and 2.

Each of the control units 11, as previously noted and described, is mounted within the lateral space between adjacent belts 10*a*. Each unit 11, as more clearly shown in FIGS. 3 and 3A, includes the illustrated tubular member 13 having the rectangular nozzle bar 25 welded or adhesively affixed to the top of the tubular member 13, with the nozzle openings 12 formed therein in alignment with openings in member 13. Bar 25 has a flat top wall with a surface cover 26, such as a belt material, which is suitably secured as by an adhesive or otherwise to the top wall to provide proper high friction support of the sheets 2.

The downstream end of the tubular member 13 is closed by an end plug 27 to form a vacuum chamber within the bore 28 of the tubular member 13. The plug 27 projects outwardly to the pivot unit 14. A vacuum connector 29 is secured to the underside of the leading end of tubular member 13 adjacent the end of the bar 25 and is connected through a suitable line 29*a*, such as a flexible vacuum line to a vacuum source 19. An electrically controlled valve 30 is shown connected in the vacuum line 29*a* to selectively establish the vacuum during the stopping cycle and to rapidly remove the vacuum at the end of the stopping cycle.

With the vacuum present in the tubular member 13, the piston 17 controls the coupling of the vacuum nozzle openings 12 to the bar 25. The piston 17 is provided with an O-ring seal 30*a* on its inner end portion and defines a sealed sliding connection within the bore 28 of the member 13 and thereby defines a sealed vacuum chamber between the piston and the end plug 27 of the member 13. The piston 17 is secured to a piston rod 31 which is connected to drive assembly 16. The assembly 16 operates to move the piston and successively uncover the discharge openings in the nozzle bar 25. As each opening 12 is uncovered, the desired vacuum pressure condition is transmitted via the opening to grasp and firmly hold the sheet 2 to the bar.

The plug 27 is a rigid rod-like member which projects from the tubular member, which extends downstream slightly from the vacuum connection. The power lift or positioning unit 18 is secured to the lifting unit at the outer end of the plug 27. The power lift 18 is shown including an air cylinder 32 having one end of the cylinder secured to the frame structure and having an outwardly projecting piston rod 33 connected to the end of plug 27 by the pivot unit 14. The rod 33 extends into and is connected to a piston 34 in cylinder 32 which is coupled to a suitable supply 35 via an air control valve 36 of pressurized air for raising and lowering of the lifting unit. The lifting unit 18 in the lowered position is inclined downwardly at a selected angle from the pivot unit 14, with the top cover 26 of the nozzle bar 25 below the belts 10*a*.

The nozzle bar 25 includes the appropriately spaced nozzle openings 12 which are connected to the bore 28 via aligned openings in the tubular member 13. The plurality of openings 12 terminate in the common plane of the top cover 26 of the nozzle bar 25 and are spaced to the trailing end portion of sheet 2, in the stream of incoming sheets. The holding force on the sheet 2 is sufficient to hold the sheet abutting the bar and preventing further downstream motion.

The nozzle openings 12 are all correspondingly formed and are longitudinally equally spaced along the length of the bar 25 with at least one opening 12 located for coupling to the trailing portion of each overlapping sheet 2. Thus, depending upon the degree of overlap provided within the incoming sheets 2, as shown as unit 5, one or more of the vacuum openings 12 of any one lifting member 13 will engage the trailing portion of the sheet 2 as it is lifted from the conveyor belts 10*a* and positively terminates its movement.

Figure 3:
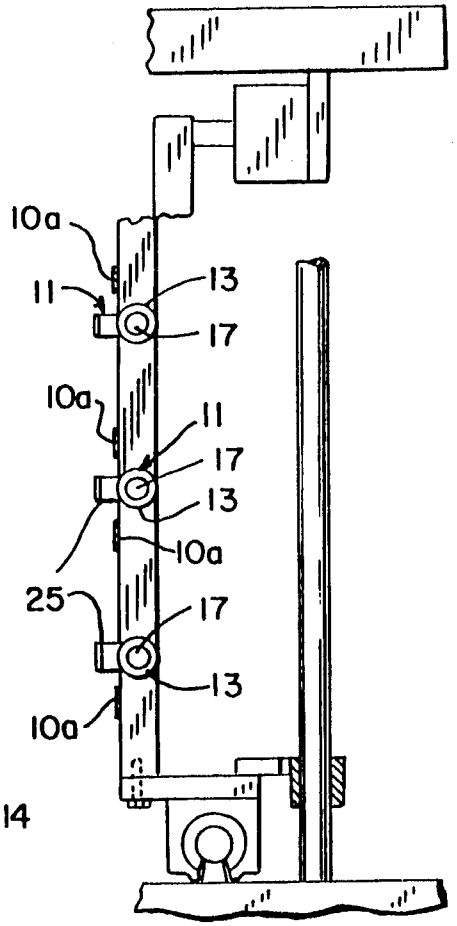
FIG. 3 is an enlarged sectional view taken generally on line 3—3 of FIG. 2.
Figure 2:
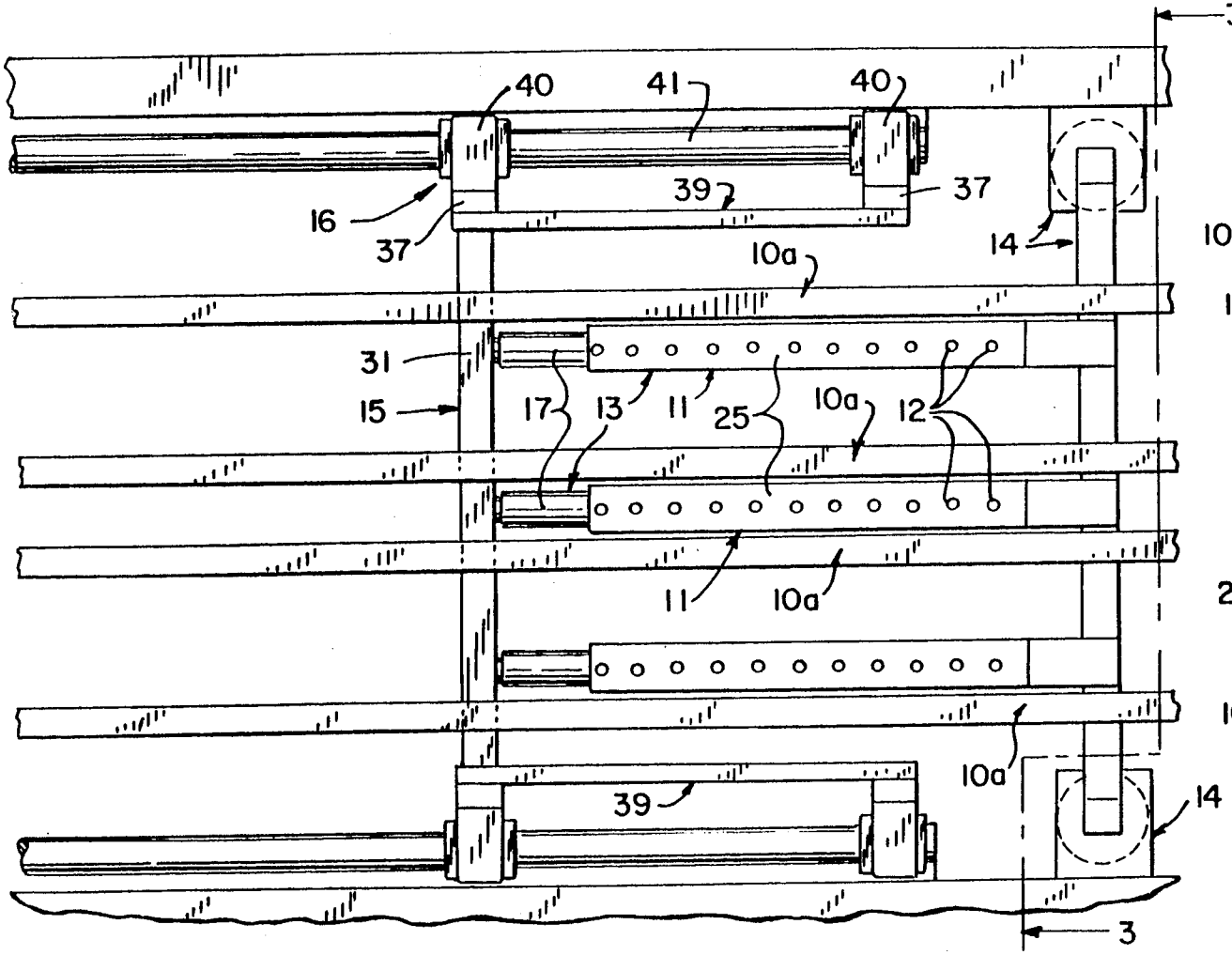
FIG. 2 is a plan view of the stacking and batching apparatus shown in FIG. 1.

As shown in FIGS. 2 and 3, the upstream end of the piston 17 projects outwardly of the upstream and open end of the tubular member 13 and is connected to a cross rod 31, common to all pistons 17.

The drive assembly 16 is similarly coupled to each end of rod 31 and includes a link 37 interconnecting the outer end of rod 31 to a motor driven linear rack 39. Movement of the rack 39 produces a simultaneous pivoting movement of the tubular member 13 about the downstream pivot unit 14 in response to reciprocation of the rod 31 and piston 17 within the tubular member 13.

The apparatus thus functions to sequentially form batches 7 of precisely the same number of sheets 2 which are transferred to the receiver 21 to form successive stacks 3 of the same number of sheets.

The rack 39 includes a pair of spaced journals 40 slidably mounted on a cam rod 41, which is fixedly mounted to the machine frame. Rack 39 is coupled via a coupling gear 42 to a suitable reversible electric motor 43. The cam rod 41 is mounted at an inclination to the horizontal plane of the conveyor belts 10. In the illustrated embodiment, the rod 41 lies in a vertical plane. The cam rod 41 is oriented below the conveyor belts, with the upstream end above the downstream end.

Figure 4A:
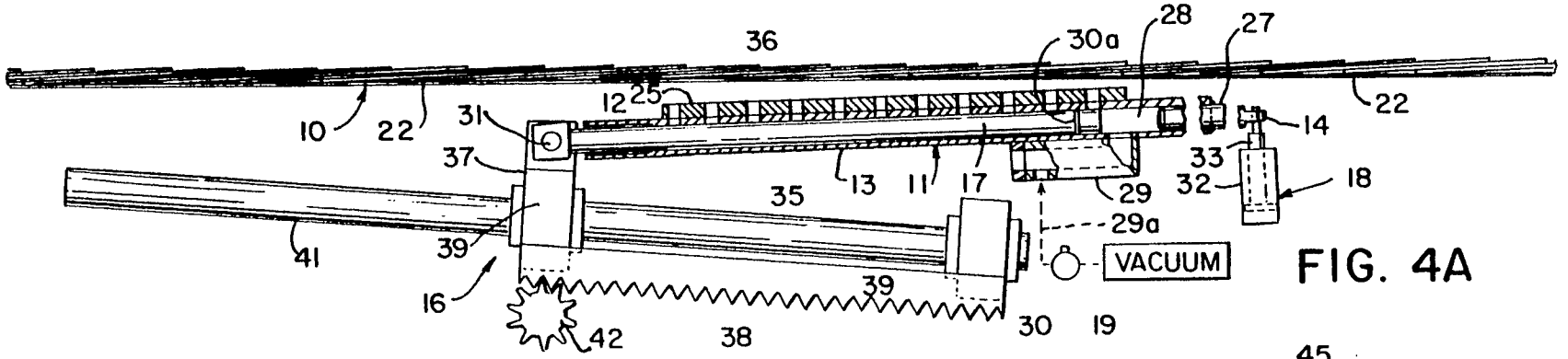
FIG. 4A–4C is a series of simplified views similar to FIG. 3 illustrating the sequential operation of the batching apparatus and stacking apparatus shown in FIGS. 1–3.

In the initial or starting home position, as shown in FIG. 4A, the rack 39 is located on the lower end portion of the cam rod 41. When the leading sheets of a batch are to be held within the unit 5, the motordriven gear 42 is actuated and drives the rack 39 upwardly on the cam rod 41, simultaneously pulling the piston 17 from the tubular member 13 and pivoting the member about the raised pivot unit 14. The outward movement of the piston 17 correspondingly varies the size of the vacuum chamber, as shown in FIGS. 4A and 4C, to selectively and sequentially uncover the vacuum nozzle openings 12. The rack 39 and the attached pistons 17 move at a speed related to the belts 10*a* to form and maintain the gap 8*a* between successive batches or groups of the sheets 2 passed through the separating apparatus or unit 5.

Figure 4B:
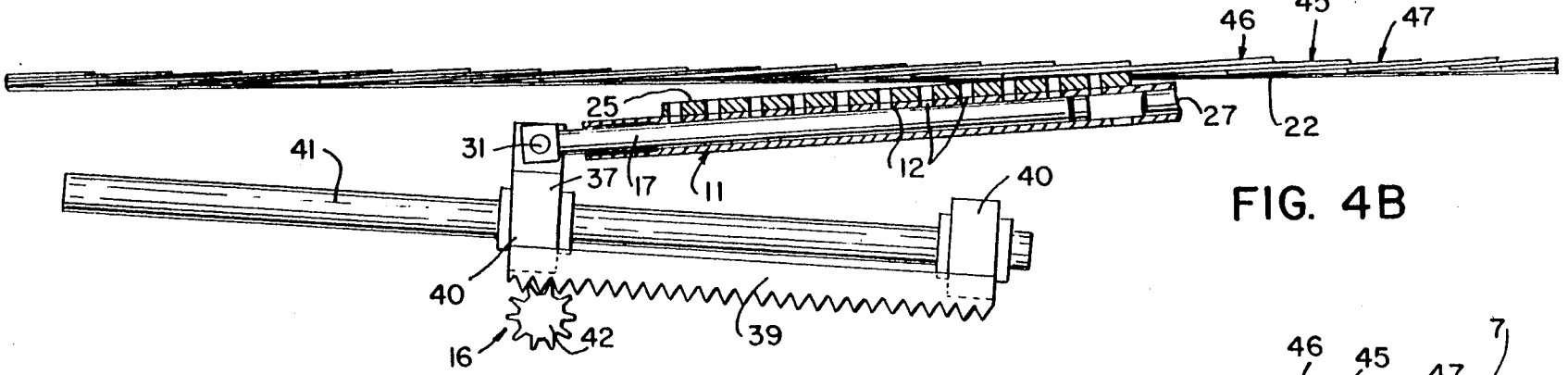
Figure 4C:
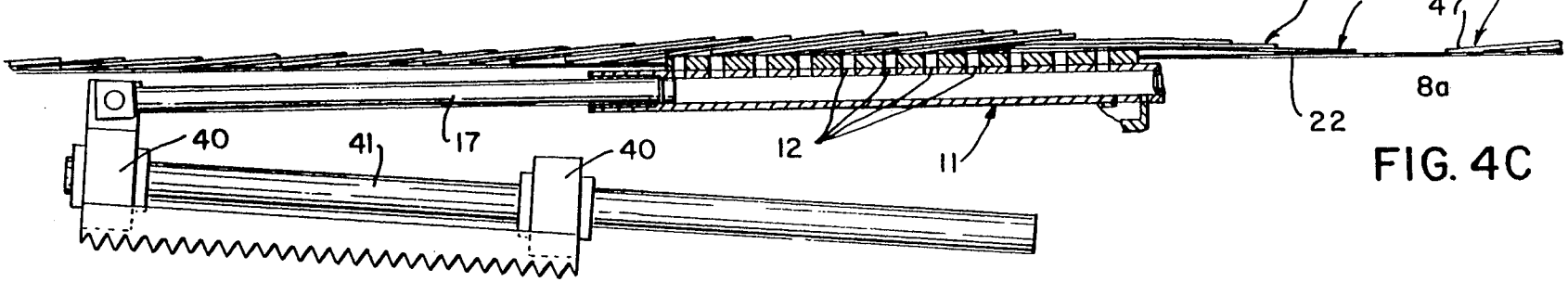

Referring particularly to FIG. 4B, the members 13 and bars 25 have been raised by the raising of the pivot unit 14 to lift the aligned downstream sheets 2 from the belts 10*a*, with the rack 39 in the initial position. In this position, the one sheet, specifically identified by number 45, and particularly the trailing portion of such sheet is aligned with the first nozzle opening 12, which has been uncovered by the simultaneous action of the motor 43 with the pivoting to withdraw piston 17. The movement of this one sheet 45 is therefore stopped. The upstream sheets 2 are moving at the speed of the belts 10*a* and the immediately following sheet 46 moves upwardly over sheet 45, and thereby increasing the overlap. The other following upstream sheets 2 correspondingly move into a greater overlap downstream. All of the preceding sheets 2 continue to move at the speed of the belts 10*a*.

The downstream sheets 47 forming the trailing end of the preceding batch 7 move from beneath the sheet 45 and move the trailing end of the downstream batch from the leading end of the next batch which are now held in the separating unit 5, forming gap 8*a*, as shown in FIG. 4C.

By appropriate moving of the piston 17 relative to belts 10*a*, the several sheets 2 in the unit 5 are similarly overlapped as shown in FIG. 4C, resulting in gap 8*a*. After an appropriate length gap 8*a* has been formed, the pivot unit 14 is lowered to release the raised sheets 2 onto the conveyor belts 10*a*, and the vacuum is simultaneously removed by closing the vacuum valve or the like. The batch of sheets is thus released to the belts 10*a* which move as a new batch 7 from unit 5 onto conveyor 8, with the gap 8*a* therebetween.

A simultaneous reversal of the lift and drive assembly 16 is initiated, with the lift unit 18 dropping the downstream end of the bars 25 and the motor 43 reversing the movement of rack 39 and interconnected pistons 17 to reset the lifting and control units 11.

The rack 39 and the pistons 17 are reset, and the apparatus is in condition to recycle and create another gap when the total sheets of the new batch have moved through the separating unit 5.

Any suitable control unit 48 can be provided to control the several positions of the control unit 11 in relationship to the conveyor and sheet movement, as diagrammatically illustrated.

The apparatus thus functions to sequentially form the gap 8*a* between successive batches 7 of the desired number of sheets 2, which are transferred to conveyor 8 and therefrom to the receiver to form successive stacks 3 of the same number of sheets.

Although the control units 11 are illustrated as an integrated lift and vacuum unit, obviously separate lift and vacuum elements could be provided with appropriate location and positioning to effect the functions of lifting of the overlapping sheets and separately applying a holding force to the members moving through a suitable apertured conveyor unit. Thus, although shown as a belt conveyor, any other suitable conveyor having spaced openings which permit the lift of the members and the application of the holding force may be provided. Further, if desired, a top holding force could be used. For example, a top bar, wheels or belt member, air pressure elements or other devices mounted above the downstream end of the vacuum bar to create a stopping force may be provided to further improve the sheet stopping ability of the apparatus. These and similar modifications can be used within the scope of the definition of the various means, control units and devices described and defined in the claims. Thus, within the broadest concepts of the present invention, the sheet stopping and gap forming control unit includes the combination of means to relatively position the overlapping incoming sheets in spaced relation to a conveyor unit in combination with a means for establishing a positive fluid holding force on each sheet in a flowing stream to produce increased overlapping of the sheets such that the downstream sheets move therefrom to form a gap between successive groups or batches of the sheets without the necessity of changing the conveying units of the line or having the stopped sheets or other such articles held against the moving conveyor.

Various modes of carrying out the invention are contemplated as being within the scope of the following claims particularly pointing out and distinctly claiming the subject matter which is regarded as the invention.

I claim:

1. An apparatus for stopping the leading members of partially overlapping members which are moving as a part of a continuous incoming stream to form gaps between batches of said overlapping members, each overlapping member having a leading portion overlapping a preceding member and a trailing portion extending from said preceding member, comprising a conveying means receiving said partially overlapping members of said incoming stream and creating a forward moving force on said members and thereby transporting said overlapping members between an infeed end and a discharge end of said conveying means for discharging a stream of partially overlapping members, laterally spaced and vertically movable means adapted to move upwardly and raise said overlapping members from the conveying means to thereby remove the forward moving force from the members, and fluid holding means engaged with successive one of said overlapping members upon the raising of said overlapping members from said conveying means to positively retard the members against forward movement and thereby create a continuous increase in the partial overlap between successive members, and means for cyclically and periodically actuating said vertically movable means and said fluid holding means to form a gap between sequential batches of said discharging stream of partially overlapping members.

2. The apparatus of claim 1 wherein said fluid holding means engages each of said successive members in the leading portion of each said batch.

3. The apparatus of claim 1 wherein said fluid holding means includes a vacuum unit creating a vacuuming force engaging the trailing portion and underside of said partially overlapping members through said conveyor means.

4. The apparatus of claim 1 wherein said conveying means includes a belt conveyor including a plurality of laterally spaced conveying belts defining a common horizontal plane for transport of the overlapping members, said vertically movable means including lifting units located between said belts and extending throughout the downstream end portion of said conveyor and having a vertical power unit for simultaneously raising of said lifting units with the downstream end portions of the lifting units moving upwardly between the belts prior to the upstream end portions and progressively raising the lifting units above the conveying belts, said fluid holding means including a vacuum unit coupled to said lifting units and successively operated to engage the aligned trailing portion of each overlapping member beginning with an overlapping member at the downstream end of the conveyor and creating a vacuum force on the trailing portion to positively hold the overlapping member to the lifting unit and thereby establish and hold the members in an increased overlapping orientation.

5. The apparatus of claim 4 wherein said vertical power unit lowers said lifting units to return the raised overlapping members to said belts and operatively shuts down said vacuum unit to permit full speed transport of the overlapping members.

6. The apparatus of claim 1 wherein overlapping members are sheet-like members and said conveying means includes a plurality of laterally spaced corresponding endless belts located in a common transport plane and coupled to a single common drive for simultaneous and continuous movement, means for feeding said partially overlapping sheet-like members to said conveying belts for movement in partial overlapping relationship by said conveying belts, said vertically movable means includes lifting units located one each between each of said laterally spaced belts, each of said lifting units including a tubular member and nozzle bar having a flat upper surface, a pivot means connected to the downstream end of said bar, said holding means including a vacuum source connected to said downstream end of said tubular member, said vertically movable means including a first vertical motor means secured to said pivot means for raising of said lifting units above the level of said belts, a vacuum control member slidably mounted in each of said tubular members and projecting outwardly from the upstream end of said tubular members, said vertically movable means including a second vertical motor means coupled to said vacuum control members and operable to lift and lower said vacuum control members and simultaneously moving said vacuum control members axially from and into said tubular member and thereby providing progressive raising of said nozzle bar upwardly between said belts and positioning said vacuum control member within said tubular member to establish a vacuum in said nozzle bar, said bar having a plurality of longitudinally spaced vacuum openings aligned with the trailing portion of said overlapping members on said bar and operable to clamp the member to said nozzle bar to hold said member in fixed orientation with respect to the other overlapping members and establishing said increased partial overlapped orientation of successive overlapping members.

7. The apparatus of claim 6 wherein said second vertical motor means includes an operator member connected to said vacuum control member, an inclined cam member, a follower secured to said operator member and coupled to said cam member, and a drive motor unit coupled to move said operator member and horizontally moving said operator member whereby said follower and said cam member functions to progressively withdraw said vacuum control member from said tubular bar and simultaneously lower or raise said tubular member and nozzle bar on said pivot means.

8. The apparatus of claim 1 including a stacking apparatus coupled to the downstream end of said conveying means to receive and stack said overlapping members, and means to remove stacked overlapping members during the period of the gap between said batches of overlapping members.

9. The apparatus of claim 1 wherein said holding means includes a vacuum means engaging the trailing portion of each overlapping member.

10. An apparatus for transporting overlapped sheet-like members and for separating of said members, said overlapped members having a leading portion overlapping a preceding member and a trailing portion extending from said preceding member, comprising a multiple belt conveying means including a plurality of laterally spaced conveying belts and a plurality of lift units located between said conveying belts, said overlapping members being transported by said conveying belts, said lift units having openings spaced for alignment with the trailing portion of the overlapping members, and a vacuum unit connected to said lift units and selectively supplying a vacuum to said openings for clamping said members to said lift unit and holding said members in a relatively fixed orientation with respect to the other overlapping members and to thereby increase the overlapped orientation of the clamped members and the following member.

11. The apparatus of claim 10 wherein each said lift unit is a tubular member having a upstream portion and a downstream portion, said vacuum unit being connected to the downstream end of said tubular member, a vertically moving member pivotally connected to said tubular member to raise the downstream end of the tubular member, a piston member slidably mounted in said tubular member and extending outwardly of the upstream end of said tubular member, a power drive unit coupled to said piston member and moving said piston member horizontally and vertically and thereby progressively withdrawing said piston member from said tubular member and simultaneously raising the tubular member.

12. The apparatus of claim 11 wherein said drive unit includes a drive motor, a cam unit coupled to and driven by said motor and including a follower coupled to said piston member and operable to horizontally move the member and thereby cause retraction and pivoting of said rod and bar.

13. The apparatus of claim 12 wherein said cam unit includes an inclined plane member and said follower riding on said inclined plane member.

14. The apparatus of claim 11 including a stacking apparatus secured adjacent the downstream end of said conveying means to receive said overlapping members from said conveying means, said stacking apparatus having vertical movable means for receiving said overlapping member and moving downwardly with the accumulation of said members, and means for removing said stack of members within the period of said gap.

15. An apparatus for sequentially stopping movement of overlapping members in a stream of overlapped members having a degree of overlapping substantially less than the permissible overlapping of said overlapped members, comprising a belt conveyor including a plurality of laterally spaced belts defining a common plane for transport of the stream of overlapping members, a plurality of lifting units having a leading end portion and a trailing end portion located between said belts, vertical moving means for simultaneously raising of said lifting unit with the leading end portions of the lifting units moving upwardly between the belts prior to the trailing end portions and thereafter progressively raising the lifting units from the conveying belt means about the leading end portion, vacuum holding units coupled to said lifting units and successively operated to engage the aligned trailing portion of each overlapping member to positively hold the overlapping member to the lifting unit and thereby establish and hold the members with an increased overlapping orientation, and said vertical moving means lowering said lifting units to return said overlapped members to said belts and to release said vacuum holding units to permit full speed transport of the overlapped members.

16. The method of sequentially establishing spaced groups of partially overlapping members in a stream of partially overlapping members, comprising transporting a stream of the overlapping members by a moving conveying unit creating a downstream propulsion force on said stream in a given plane, successively lifting said overlapping members from said conveying unit and thereby removing the forward propulsion forces of said conveying unit from the members, applying a fluid holding force to each of said member as the member is lifted from said conveying unit and thereby arresting movement of the lifted member and substantially holding the member in predetermined fixed relation to said conveying unit to thereby increase the partial overlap of the upstream member onto the downstream member, releasing said fluid holding means and lowering said lifted members onto said conveying unit for transport of said members as a part of a group of overlapping members, and sequentially lifting and lowering said members in repeated cycles to provided sequential transport of said overlapping members in sequential groups with a gap between successive groups of said members in a continuous cyclical manner.

17. The method of claim 16 wherein said step of lifting said overlapping members includes the step of pivoting a lift bar from below said conveying unit to above said conveying unit and thereby progressively and continuously lifting of said overlapping members into an inclined plane beginning at a downstream portion of said conveying unit.

18. The method of claim 16 or 17 wherein the step of applying said fluid holding force includes applying a vacuum to the trailing end portion of each overlapping member simultaneously with the lifting of the members from the conveying unit.

* * * * *